United States Patent [19]

Wiedemann et al.

[11] Patent Number: 4,818,653

[45] Date of Patent: Apr. 4, 1989

[54] ELECTROPHOTOGRAPHIC RECORDING MATERIAL WITH MOPOMERIL ALLEPTOR ADDITIVE

[75] Inventors: Wolfgang Wiedemann, Geisenheim-Johannisberg; Michael Drexler, Bischofsheim; Juergen Fuerderer, Mainz, all of Fed. Rep. of Germany

[73] Assignee: Hoechst Aktiengesellschaft, Fed. Rep. of Germany

[21] Appl. No.: 922,332

[22] Filed: Oct. 23, 1986

[30] Foreign Application Priority Data

Oct. 25, 1985 [DE] Fed. Rep. of Germany ..... 3537979

[51] Int. Cl.[4] ..... G03G 5/14; G03G 5/09

[52] U.S. Cl. ..... 430/59; 430/58; 430/900; 430/64

[58] Field of Search ..... 430/58, 59, 900, 64

[56] References Cited

U.S. PATENT DOCUMENTS

| | | | |
|---|---|---|---|
| 3,121,006 | 2/1964 | Middleton et al. | 430/84 X |
| 3,640,708 | 2/1972 | Humphriss et al. | 430/64 |
| 3,928,034 | 12/1975 | Regensburger | 430/58 |
| 4,047,948 | 9/1977 | Horgan | 430/59 |
| 4,052,205 | 10/1977 | Stolka et al. | 430/58 |
| 4,072,520 | 2/1978 | Rochlitz et al. | 430/59 |
| 4,106,934 | 8/1978 | Turnblom | 430/58 X |
| 4,220,697 | 9/1980 | Wiedemann | 430/58 X |
| 4,264,695 | 4/1981 | Kozima et al. | 430/58 |
| 4,302,521 | 11/1981 | Takei et al. | 430/58 X |
| 4,535,045 | 8/1985 | Kawamura et al. | 430/58 X |

FOREIGN PATENT DOCUMENTS

| | | | |
|---|---|---|---|
| 54-10738 | 1/1979 | Japan | 430/58 |

*Primary Examiner*—Roland E. Martin

*Attorney, Agent, or Firm*—Foley & Lardner, Schwartz, Jeffery, Schwaab, Mack, Blumenthal & Evans

[57] ABSTRACT

An electrophotographic recording material is described that comprises an electrically conducting base layer and a photoconductive system deposited thereon, which system comprises an optional insulating intermediate layer, a layer containing a charge-generating compound, and a layer containing a charge-transporting compound mixed with binders, along with any sensitizers, acceptors and usual additives. The photoconductive system contains, as acceptor additive, one or more monomeric or polymeric compounds that have electron-attracting substitutents (halogen, cyano, nitro groups) and that are selected from the group consisting of anthracene, acridine, the anhydrides of phthalic acid, maleic acid, pyromellitic acid, benzophenonetetracarboxylic acid, and the polymers of vinyl chloride, vinylidine chloride and nitrocellulose, in a quantity of 0.2 to 10% by weight based on total coating weight. After erasure of the latent electrostatic image, the recording material has a low residual charge, even when operated cyclically. Background imaging is thereby avoided.

9 Claims, 1 Drawing Sheet

ELECTROPHOTOGRAPHIC RECORDING MATERIAL WITH MOPOMERIL ALLEPTOR ADDITIVE

BACKGROUND OF THE INVENTION

The present invention relates to an electrophotographic recording material comprising an electrically conducting base layer and a photoconductive system provided thereon, which system comprises an optional insulating intermediate layer, a layer containing a chargecarrier generating compound, and a layer containing a charge-transporting compound mixed with a binder, as well as with sensitizers, acceptors and conventional additives.

The use of sensitizers and acceptors in photoconductive systems, particularly in a photoconductive double-layer arrangement, is known (see German patent No. 1,127,218, corresponding to U.S. Pat. No. 3,287,123; German Auslegeschrift No. 1,572,347 corresponding to U.S. Pat. No. 3,484,237; and German patent No. 2,220,408, corresponding to U.S. Pat. No. 3,973,959).

In German Offenlegungsschrift No. 3,331,592, corresponding to British patent No. 2,130,597, photoconductive layers are described that contain, for example, methyl violet or rhodamine B as sensitizers and, for example, tetracyanoethylene or chloranil as acceptors. With the charge-transporting compounds, they often form colored charge-transfer complexes which may result in an undesirable increase in conductivity in the dark and unstable charging characteristics.

In European patent application No. 0 069 397, photoconductive double layers are described which contain dicyanovinyl compounds as acceptors in the transport layer. These compounds and their charge-transfer complexes have interfering inherent absorption in the blue spectral region up to about 475 nm. In addition, they can only be prepared in a two-stage synthesis step.

European patent No. 0 058 084 describes a sensitizer of the nitrophthalic anhydride type which is suitable for activating monodisperse photoconductive films containing phthalocyanine derivatives and polyester resins.

It is further known from German patent No. 2,734,288, corresponding to U.S. Pat. No. 4,220,697, that certain organic photoconductors and pigments in combination with cellulose nitrates yield highly sensitive photoconductive double layers. But a disadvantage in this connection is a higher pre-exposure sensitivity.

The known publications regarding photoconductive double layer arrangements disclose materials containing various pigments that impart good photosensitivity. The residual discharge properties of these materials, and their occasionally encountered, unstable cyclic characteristics are still unsatisfactory. The residual discharge properties and unstable characteristics which are also binder-dependent, involve variation in charge acceptance and increasing residual charge in cyclic copier operation.

SUMMARY OF THE INVENTION

It is therefore an object of the present invention to improve the residual discharge properties and the cyclic characteristics of photoconductive systems in double-layer arrangements, without substantially affecting other good electrophotographic parameters, such as pre-exposure insensitivity and charge acceptance.

In accomplishing this object, there has been provided an electrophotograhic recording material comprising an electrically conducting base layer and a photoconductive system deposited thereon which comprises a layer containing a charge-carrier generating compound and a layer containing a charge-transporting compound mixed with a binder, wherein the photoconductive system contains at least one monomeric or polymeric acceptor additive that has electron-attracting substituents and that is selected from the group consisting of an anthracene, an acridine, an anhydride of an acid from the group of phthalic acid, maleic acid, pyromellitic acid and benzophenonetetracarboxylic acid, a polymer of vinyl chloride, a polymer of vinylidine chloride and a polymer of nitrocellulose, said compound being present in an amount ranging between about 0.2 to 10% by weight, based on the total coating.

Halogen, such as chlorine or bromine, a cyano group or a nitro group can act as electron-attracting substituents in this regard. Preferably, the photoconductive system contains a compound represented by the formula

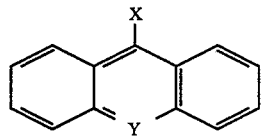

where

X denotes hydrogen, halogen, such as chlorine or bromine, a cyano group and

Y denotes nitrogen or the grouping

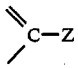

where

Z denotes halogen, such as chlorine or bromine, or a cyano group.

Compounds that are preferably employed as acceptor additives include 9,10-dibromoanthracene, 9,10-dichloroanthracene, 9-chloroanthracene, 9-bromoanthracene and 9-chloroacridine.

Other objects, features and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF PREFERRED EMBODIMENTS

It has been discovered that photoconductive systems which have very good photosensitivity are improved in their residual discharge properties by the present invention. This effect may be described as follows: in the case of initial cyclic copying, the photoconducting layers are very rapidly discharged, in accordance with their high sensitivity, which is confirmed by the low half-value energy. Under certain copying conditions, however, the layers still have an insufficiently erasible residual charge which increases with an increasing number of cycles, gradually resulting in undesirable background imaging. This effect is prevented by the present invention.

The above-decribed compounds of the present invention are preferably used in an amount ranging between 0.5 and 6% by weight, based on the total coating weight. These acceptor additives produce a reduction of the residual discharge in a photoconductive system, and also effect an improved constancy of the cyclic parameters, without imparing other good electrophotographic properties, such as photosensitivity, charge acceptance and dark decay.

The acceptor additives are preferably contained in the layer containing the charge-transporting compound. But it has been found that the additives also markedly improve the electrophotographic properties if they are added individually to the first coating of an insulating intermediate layer in contact with the charge-carrier generating layer.

Figure 1:
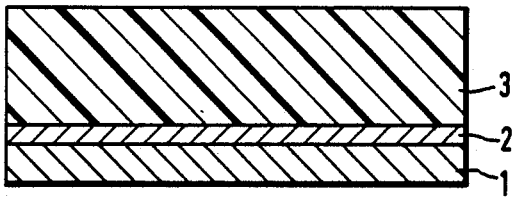
FIGS. 1-3 are schematic representations, in cross-sectional perspective, of three different electrophotographic recording materials within the present invention.
Figure 2:
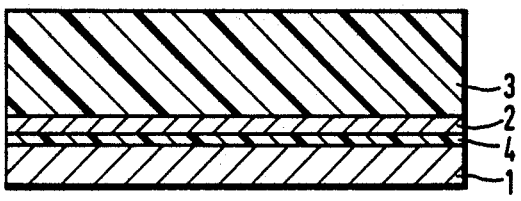
Figure 3:
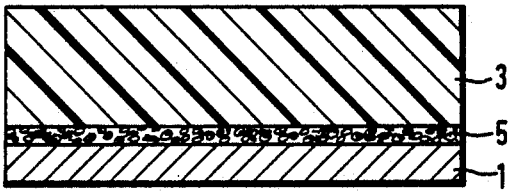

The structure of electrophotographic recording material within the present invention is explained diagrammatically with reference to the attached FIGS. 1 to 3. In each case, element 1 is an electrically conducting base layer, element 2 is a charge-carrier generating layer and element 3 is a charge-transporting layer. Element 4 is an optional insulating intermediate layer, and element 5 is a charge-carrier generating layer which is comprised of a pigment dispersed, for example, in a binder.

Aluminum foil or, if appropriate, transparent polyester film which is aluminum-clad or is coated with aluminum by vapor deposition or sputtering, can be used as the electrically conducting base layer. But any other carrier material rendered sufficiently conductive (for example, by means of carbonblack or metal powder) can also be used. The photoconductive system can also be arranged on a drum, on flexible endless belts, for example of nickel or steel, or on plates (for example, of aluminum).

An insulating intermediate layer and, if appropriate, a thermally, anodically or chemically generated aluminum oxide intermediate layer (see FIG. 2, element 4), is introduced with the objective of reducing charge carrier injection in the dark from the metal into the photoconductive layer. On the other hand, the insulating layer should not prevent charge flow during the exposure process. The intermediate layer acts as a barrier layer and also serves, as needed, to improve adhesion between the base layer surface and the dyestuff layer or photoconductor layer.

Various natural or synthetic resin binders can be used for the intermediate layer, but those materials are preferred that adhere well to a metal surface, especially to an aluminum surface, and undergo little dissolution when additional layers are applied subsequently. These include polyamide resins, polyvinylalcohols, polyvinylphosphonic acid, polyurethanes, polyester resins, polycarbonates, phenoxy resins, cellulose nitrates, PVC/PVAc copolymers, and copolymers of styrene and butadiene, (meth)acrylic acid esters and maleic acid anhydride. Addition of the acceptor additives according to the present invention to the preliminary coating improves the electrophotographic characteristics.

The thickness of the organic intermediate layers can be up to 5 μm, and that of an aluminum-oxide intermediate layer is generally in the range from 0.01 to 1 μm.

The inventive layer 2 or 5 (FIGS. 1 to 3) has the function of a charge-carrier generating layer; the pigment used in this connection determines the spectral photosensitivity of the photoconductive system by virtue of its absorption characteristics. Pigments preferably used for this purpose are: perylimide derivatives, cis- and trans-perinones, phthalocyanines (metal-containing and metal-free), thioindigo, dioxazine and quinacridone derivatives, perylene-3,4,9,10-tetracarboxylic acid bisbenzimidazole derivatives, polynuclear quinones, e.g. 4,10-dibromoanthanthrone (C.I. 59,300), and azo and bisazo dyestuffs.

The application of a homogeneous, densely packed pigment layer is preferably achieved by vapor deposition of the pigment onto the base layer in vacuo. Depending on the vacuum level, the dyestuff can be deposited by evaporation without decomposing under conditions of $1.33\times10^{-6}$ to $10^{-8}$ bar and a heating temperature of 240° to 290° C. At the same time, the temperature of the layer base layer is below 50° C. As a result, layers are obtained that contain densely packed dyestuff molecules. This has the advantage, over all other possibilities, of generating extra thin homogeneous dyestuff layers, ensuring an optimum charge generation rate. The extremely finely dispersed distribution of the pigment makes possible a high concentration of activated dyestuff molecules which inject charges into the charge-transport layer. In addition, charge transport through the dyestuff layer is not impeded, or only slightly impeded, by binders.

An advantageous layer-thickness range for the vapor-deposited pigment is between 0.005 and 3 μm. Particularly preferred is a thickness range between 0.05 and 1.5 μm, since in this range the adhesive strength and homogeneity of the vapor-deposited pigment are particularly favorable.

Apart from vapor deposition of the pigment, a uniform pigment thickness can also be achieved by other coating techniques. These techniques include application by mechanically rubbing the superfinely powdered material into the electrically conducting base layer, and application by electrolytic or electrochemical processes or by an elctrostatic spraying method.

In combination with, or in lieu of an intermediate layer, homogeneous pigment layers which provide good coverage and have thicknesses on the order of 0.05 to 3 μm can also be prepared by grinding the pigment together with a binder, in particular with cellulose nitrates and/or crosslinking binder systems, such as acrylic resins crosslinkable with polyisocyanate, and with reactive resins such as epoxides and DD lacquers. The resulting pigment dispersions can then be coated onto the base layer to provide element 5 in FIG. 3. Binders like polystyrene, styrene/maleic acid anhydride copolymers, polymethacrylates, polyvinyl acetates, polyurethanes, polyvinylbutyrals, polycarbonates, polyesters and phenoxy resins, and mixtures thereof, are also suitable.

The pigment/binder ratio can vary within wide limits, but pigment primer coatings are preferred wherein the pigment proportion is over 50%, as reflected in a correspondingly high optical density. In addition, the compounds according to the present invention can be added to the dispersions.

Organic compounds that have an extended $\pi$-electron system are particularly suitable as the chargetransport material in the present invention. These compounds include both monomeric and polymeric aromatic and heterocyclic compounds. Particularly suitable are those monomers that have at least one tertiary-bonded nitrogen atom and/or a dialkylamino group. Heterocyclic compounds such as oxadiazole derivatives, which are mentioned in German patent No. 1,058,836 (corresponding to U.S. Pat. No. 3,189,447), have proved especially successful. These derivatives include, in particular, 2,5-bis(p-diethylaminophenyl)-1,3,4-oxadiazole; in addition, unsymmetrical oxadiazoles like 5-[3-(9-ethyl)carbazolyl]-1,3,4-oxadiazole derivatives (U.S. Pat. No. 4,192,677), for instance 2-(4-dialkylaminophenyl)-5-[3(9-ethyl)carbazolyl]-1,3,4-oxadiazole, can be used with success.

Other suitable monomeric compounds are arylamine derivatives (triphenylamine) and also triarylmethane derivatives (German patent No. 1,237,900), for example, bis(4-diethyl-amino-2-methylphenyl)phenylmethane; more highly condensed aromatic compounds such as pyrene; and benzo-condensed heterocyclic compounds (e.g., benzoxazole derivatives). In addition, pyrazolines like 1,3,5-triphenylpyrazolines or imidazole derivatives (German patents No. 1,060,714 and No. 1,106,599, corresponding to U.S. Pat. No. 3,180,729 and British patent No. 938,434, respectively are suitable. To these also belong triazole, thiadiazole and especially oxazole derivatives, for example, 2-phenyl-4-(2-chlorophenyl)-5-(4-diethylaminophenyl)-oxazole, as disclosed in German patents No. 1,060,260, No. 1,299,296 and No. 1,120,875 (corresponding to U.S. Pat. No. 3,112,197, British patent No. 1,016,520 and U.S. Pat. No. 3,257,203, respectively).

Furthermore, 4-chloro-2-(4-dialkylaminophenyl)5-aryloxazole derivatives represented by the following formula are of great interest:

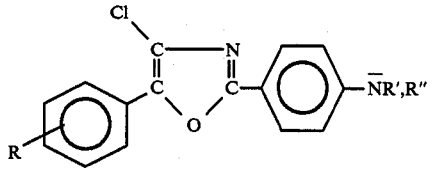

where

R is hydrogen, halogen, alkyl or alkoxy and R', R'' are alkyl.

The preparation of these derivatives is known from European patent No. 0 010 652.

Similarly of interest in this regard are hydrazone derivatives of the following structure:

$$R-A-CH=N-\underset{\underset{R_1}{|}}{N}-Ar$$

where

R is hydrogen, halogen, alkyl, alkoxyl or dialkylamino and $R_1$ is alkyl or aryl, such as benzyl, for instance, $$3\text{-(9-ethyl)carbazolyl-}CH=N-\underset{\underset{R}{|}}{N}-Ar.$$

These compounds, described in U.S. Pat. No. 4,150,987 and in German Offenlegungsschriften No. 2,941,509, No. 2,919,791 and No. 2,939,483 (corresponding to U.S. Pat. No. 4,338,388, U.S. Pat. No. 4,278,747 and British patent No. 2,034,493, respectively), have proved successful as charge-transport material.

As transport polymers, polyvinylcarbazole and copolymers containing at least 50% vinylcarbazole component yield a good photosensitivity.

Without dyestuff film, the charge-transporting layer region (420 to 750 nm). If negative charging is intended, layer 3 preferably comprises a mixture of an electron-donor compound (organic photoconductor) with a binder. It is preferably transparent, but this is not necessary with a transparent conducting base layer. The layer 3 has a high electrical resistance of more than $10^{12}\Omega$. In the dark it prevents scattering of the electrostatic charge; when exposed, it transports the charges generated in the dyestuff layer.

The mixing ratio of the charge-transporting compound to the binder can vary. However, the requirement of maximum photosensitivity (favoring as high a proportion as possible of charge-transporting compound) and the requirements of avoiding crystallizing out and of increasing flexibility (favoring as high a proportion of binder as possible) effectively set relatively definite limits in this regard. A mixing ratio of approximately 1:1 parts by weight has generally proved preferable, but ratios between 4:1 and 1:4 are also suitable. If polymeric charge-transporting compounds such as polyvinylcarbazole are used, binder proportions around or below 30% are suitable.

The composition of the charge-transporting layer is approximately 40 to 70% photoconductor compound, 20 to 60% binder, and up to 10% of the acceptor additive(s).

In addition to the charge-generation and charge-transport materials described, the binder which is used affects both the mechanical characteristics, such as abrasion, flexibility, film formation and adhesion, and, to a certain extent, the electrophotographic characteristics, such as photosensitivity, residual charge and cyclic characteristics, under normal conditions and also under conditions of elevated temperatures (20° to 50° C.) and humidity (greater than 80% relative humidity). Moreover, pre-exposure sensitivity can be increased by the use of certain binders, such as cellulose nitrate, with certain photoconductors, such as oxadiazole derivatives.

Used as binders are polyester resins, polyvinylacetals, polycarbonates, silicone resins, polyurethanes, epoxy resins, phenoxy resins, poly(meth)acrylates and copolymers (e.g., with styrene), polystyrenes and polystyrene copolymers (e.g., with butadiene), and cellulose derivatives like celluloseacetobutyrates. Polyester resins, polycarbonates and phenoxy resins are used, respectively, to special advantage.

Polyvinyl chloride, copolymers of vinyl chloride and vinyl acetate, polyvinylidene chlorides, polyacrylonitriles and cellulose nitrates in particular can also be blended with the above binders; a proportion of up to approximately 10% by weight, based on the proportion of solids in the charge-transport layer, has proved advantageous in this connection, without substantial increase in pre-exposure sensitivity. In addition, mixtures of polymeric and also monomeric acceptor additives, for example, cellulose nitrate and 9,10-dibromoanthracene, can be present as an activating addition to the charge-transport layer; but the optical transparency of the layer should not be substantially impaired in this case.

The thickness of the charge-transport layer is also important from the perspective of optimum photosensitivity: layer thicknesses between approximately 2 and 25 μm are generally used. A thickness range of 5 to 18 μm has proved advantageous. If the mechanical requirements and electrophotographic parameters of the charging and development stations in a copier permit, however, the specified limits may be extended upward or downward from case to case.

Conventional additives for use in the present invention include flow control agents such as silicone oils; wetting agents, in particular non-ionogenic substances; and plasticizers of various compositions, such as those based on chlorinated hydrocarbons and those based on phthalic acid esters.

The present invention is described in further detail below by reference to the following examples, which are illustrative only.

EXAMPLE 1

A polyester base layer, which had been coated beforehand with aluminum by vapor deposition, was coated by vapor deposition in vacuo ($1.33\times10^{-7}$ to $10^{-8}$ bar) with the pigment N,N'-dimethylperylimide (Formula 1 of the attached formula table) and, in addition, with the pigment N,N'-di(3-methoxypropyl)-perylimide (Formula 2) at a temperature ranging from 270° to 290° C. under mild conditions; the thicknesses of the homogeneous pigment layers were about 120 and 190 mg/m$^2$, respectively. A solution comprising equal parts by weight of 2,5-bis(4-dialkylaminophenyl)-1,3,4-oxodiazole (To 1920) and polyester resin (Dynapol ® L 206) in tetrahydrofuran was applied thereon and dried to give a thickness of 9 to 10 μm. In addition, a coating solution was prepared as described above in which 10% by weight of the polyester resin was replaced by low-viscosity cellulose nitrate (CN) (Standard type HP 10). The coating solution was spun onto the vapor-deposited pigment layers to a thickness of 9 to 10 μm (dry).

The photosensitivity of these photoconductor double layers were measured as follows:

To determine the light decay curves, the test sample was moved through a charge device to the exposure station, where it was continuously illuminated with a halogen/tungsten lamp (150 W). A heat absorption glass and a neutral filter were placed in front of the lamp. The light intensity in the measurement plane was in the range from 3 to 10 μW/cm$^2$; it was measured with an optometer in parallel with the measurement operation. The charge level and the photoinduced light decay curve were recorded with an oscillograph through a transparent probe, using an electrometer. The photoconductor film was characterized by the charge level ($U_o$) and the time (T) required to reach half, one-quarter and one-eighth of the original charge ($U_o$). The product of the particular T [s] and the light intensity (μW/cm$^2$) measured in parallel determined the characteristic energy quantities (μJ/cm$^2$), e.g., the half-value energy ($E_{\frac{1}{2}}$). The energy quantities at which $\frac{1}{4}$ or $\frac{1}{8}$ of the initial charge ($U_o$) was reached characterized the residual charge characteristic of the tested photoconductor film. The residual charge ($U_E$), predominantly measured after 1 or 3 seconds, was also a measure of the residual discharge characteristics.

| Pigment (formula) | CN added (transport layer) | $-U_o$ (V) | $E_{\frac{1}{2}}$ | $E_{\frac{1}{4}}$ | $E_{\frac{1}{8}}$ (μJ/cm$^2$) | $-U_E$ (V) 3 sec |
|---|---|---|---|---|---|---|
| 1 | — | 510 | 2.14 | 5.07 | 8.57 | 39 |
| | 10% | 530 | 1.25 | 2.48 | 3.76 | 3 |
| 2 | — | 510 | 1.54 | 3.7 | 6.49 | 31 |
| | 10% | 540 | 1.12 | 2.2 | 3.45 | 7 |

EXAMPLE 2

A solution comprising 50 parts of To 1920, 40 parts of polycarbonate (Makrolon ® 2405) and 10 parts of polyester resin (Dynapol L 206) in tetrahydrofuran was coated onto a thin vapor-deposited pigment film of N,N'-dimethylperylimide as in Example 1, and was then dried to a thickness of approximately 10 μm (O-layer). In addition, coating solutions were prepared that contained 48 parts of To 1920, with the same binder proportions as above, and in each case 2 parts of acceptor compound (see Table 1). These coating solutions were coated, respectively, onto the pigment layer to a comparable thickness and were dried. The measured photosensitivities of the O-layer and the activated charge-transport layers are shown in Table 1:

| Charge transport layer | Acceptor | $-U_o$ (V) | $-U_E$ (V) after 1 sec | $E_{\frac{1}{2}}$ | $E_{\frac{1}{4}}$ | $E_{\frac{1}{8}}$ (μJ/cm$^2$) |
|---|---|---|---|---|---|---|
| 0 | — | 470 | 47 | 1.33 | 3.18 | 8.31 |
| 1 | 9-(β,β-Dicyano-vinyl)anthracene | 470 | 51 | 1.59 | 3.87 | 9.4 |
| 2 | Phthalic anhydride | 470 | 31 | 1.21 | 2.69 | 5.62 |
| 3 | Maleic anhydride | 460 | 43 | 1.16 | 2.57 | 6.0 |
| 4 | 3,3',4,4'-benzo-phenonetetracarboxylic acid anhydride | 460 | 15 | 1.1 | 2.16 | 3.73 |
| 5 | 3,4,5,6-tetra-chlorophthalic anhydride | 450 | 11 | 1.11 | 2.16 | 3.64 |

EXAMPLE 3

Thin layers of vapor-deposited N,N'-dimethylperylimide were coated with tetrahydrofuran solutions containing various quantities of 9,10-dibromoanthracene (DBA).

The first solution of this DBA concentration series comprised 50 parts of To 1920, 39 parts of polycarbonate (Makrolon 2405), 10 parts of polyester resin (Dynapol L 206) and 1 part of DBA; the other solutions contained 2.5, 5.0 and 10 parts of DBA, respectively, instead of polycarbonate. After drying for 5 minutes at 95° to 100° C., the layer thicknesses were approximately 8μm. (The analogous 0 layer of this series has already been described in Example 2.)

The photosensitivities of the variously activated charge-transport layers are recorded in Table 2:

TABLE 2

| Layer | Proportion of DBA | $-U_o$ (V) | $U_E$ (V) after 1 sec | $E_{\frac{1}{2}}$ | $E_{\frac{1}{4}}$ | $E_{\frac{1}{8}}$ (μJ/cm²) |
|---|---|---|---|---|---|---|
| 0 | 0 | 470 | 47 | 1.33 | 3.18 | 8.31 |
| 1 | 1.0 | 470 | 47 | 1.08 | 2.4 | 5.63 |
| 2 | 2.5 | 470 | 35 | 0.98 | 2.05 | 3.95 |
| 3 | 5.0 | 460 | 31 | 0.95 | 1.9 | 3.67 |
| 4 | 10.0 | 470 | 27 | 0.88 | 1.8 | 3.29 |

EXAMPLE 4 (Comparison Example)

Samples of homogeneous, thin layers of vapordeposited N,N'-dimethylperylimide, about 100 mg/m² in thickness, were prepared as described in Example 1 and then were coated with one of the tetrahydrofuran (THF) solutions having the following composition:

(a) 70 parts of To 1920 and 30 parts of polycarbonate (Makrolon 2405);

(b) 69 parts of To 1920, 30 parts of polycarbonate and 1 part of 3,5-dinitrobenzoic acid nitrile (DBN) as acceptor compound;

(c) 67 parts of To 1920, 30 parts of polycarbonate and 3 parts of DBN.

After drying, the layer weights per unit area of these samples were 11 to 11.5 g/m². As shown below, photosensitivity in the samples deteriorated with the addition of the DBN acceptor compound:

| Layer | $-U_o$ (V) | $U_E$ (V) after 1 sec | $E_{\frac{1}{2}}$ | $E_{\frac{1}{4}}$ | $E_{\frac{1}{8}}$ (μJ/cm²) |
|---|---|---|---|---|---|
| (a) | 540 | 31 | 1.11 | 2.12 | 3.56 |
| (b) | 530 | 43 | 1.19 | 2.41 | 4.73 |
| (c) | 530 | 59 | 1.45 | 3.0 | 7.7 |

EXAMPLE 5

A thin, polycarbonate primer coating (less than 0.1 μm) was deposited on a polyester film previously coated by vapor deposition with aluminum. Trans-perinone (Hostapermorange GR, represented by Formula 3 in the formula table) was then homogeneously deposited thereon by vapor deposition in vacuo under conditions similar to those described in Example 1. The layer weight of the pigment per unit area was in the region of 120 mg/m². A charge-transport layers comprising 60 parts of To 1920 and 40 parts of phenoxy resin was coated onto the perinone pigment layer to a thickness of approximately 10 μm. Variously activated charge-transport films were also prepared in which the phenoxy resin was partially replaced by 1, 2, 3 or 5 parts of cellulose nitrate (CN) of standard type H 27, containing about 18% dioctylphthalate.

The gradual increase in measured photosensitivity is shown in Table 3:

TABLE 3

| Layer | Proportion of CN % | $-U_o$ (V) | $U_E$ (V) after 3 sec | $E_{\frac{1}{2}}$ | $E_{\frac{1}{4}}$ | $E_{\frac{1}{8}}$ (μJ/cm²) |
|---|---|---|---|---|---|---|
| 0 | 0 | 540 | 98 | 2.66 | 7.78 | |
| 1 | 1 | 580 | 23 | 1.44 | 2.56 | 4.03 |
| 2 | 2 | 545 | 15 | 1.36 | 2.41 | 3.54 |
| 3 | 3 | 550 | 11 | 1.35 | 2.36 | 3.52 |
| 4 | 5 | 525 | 7 | 1.36 | 2.35 | 3.43 |

EXAMPLE 6

With the same charge carrier-generating layer as in Example 5, 5% of a copolymer of vinyl chloride (approximately 85%), vinyl acetate and dicarboxylic acid (1%) (Hostaflex® M 131) or 5% of polyvinylidene chloride were used instead of CN as activating binder in the charge-transport layer. The resulting layers were about 10 μm thick. (The data below for the O-layer are taken from Example 5.)

| Addition of | $-U_o$ (V) | $-U_E$ (V) after 3 sec | $E_{\frac{1}{2}}$ | $E_{\frac{1}{4}}$ | $E_{\frac{1}{8}}$ (μJ/cm²) |
|---|---|---|---|---|---|
| 5% PVC | 570 | 39 | 1.66 | 3.34 | 6.31 |
| 5% PVDC | 545 | 39 | 1.81 | 3.39 | 6.17 |
| 0 | 540 | 98 | 2.66 | 7.78 | |

EXAMPLE 7

A layer of vapor-deposited N,N'-dimethylperylimide was produced on a polyester film coated with aluminum by vapor deposition and precoated with polycarbonate (less than 0.1 μm). The perylimide layer was then coated with a charge-transport layer, comprising 60 parts of To 1920 and 40 parts phenoxy resin, to a thickness of about 10 μm. In order to investigate other activating substances, a composition comprising 60 parts of To 1920, 37 parts of phenoxy resin and 3 parts of acceptor compound was chosen. The measured photosensitivities of the variously activated layers were as follows:

| Layer | Activator compound (3%) | $-U_o$ (V) | $-U_E$ (V) after 3 sec | $E_{\frac{1}{2}}$ | $E_{\frac{1}{4}}$ | $E_{\frac{1}{8}}$ (μJ/cm²) |
|---|---|---|---|---|---|---|
| 0 | 0 | 480 | 142 | 4.93 | — | — |
| 1 | 9-bromo-anthracene | 520 | 11 | 1.27 | 2.78 | 4.75 |
| 2 | 9,10-di-chloro-anthracene | 510 | 15 | 1.3 | 2.91 | 5.18 |
| 3 | 9-chloro-acridine | 395 | 7 | 1.12 | 2.33 | 3.9 |
| 4 | 1,5-di-chloroanthra-quinone | 525 | 39 | 1.64 | 3.74 | 7.29 |

EXAMPLE 8

A vapor-deposited pigment layer according to Example 1 was coated (O-layer) with a tetrahydrofuran solution, comprising equal parts by weight of To 1920 and polycarbonate (Makrolon 3200), to a thickness of 9 to 10 μm (dry). Additional layers were prepared in which the charge-transport layerm was activated with small proportions of phthalic anhydride (PA) instead of polycarbonate. Composition and photosensitivity data are shown in Table 4 (light intensity: 4.1 $\mu W/cm^2$):

TABLE 4

| Layer | PA (%) | $-U_o$ (V) | $-U_E$ (V) after 3 sec | $E_{\frac{1}{2}}$ | $E_{\frac{1}{4}}$ | $E_{\frac{1}{8}}$ ($\mu J/cm^2$) |
|---|---|---|---|---|---|---|
| 0 | — | 525 | 47 | 1.41 | 3.62 | 8.61 |
| 1 | 0.1 | 550 | 19 | 1.27 | 3.0 | 6.93 |
| 2 | 0.5 | 545 | 15 | 0.98 | 2.08 | 3.84 |
| 3 | 2.0 | 530 | 11 | 1.0 | 2.05 | 3.68 |
| 4 | 5.0 | 370 | 0 | 0.82 | 1.6 | 2.41 |

From the activation series, it can be seen that charge acceptance is reduced, under the same charging conditions, with too high a proportion of PA.

EXAMPLE 9

Polyester film coated with aluminum by vapor deposition was coated with a thin, adhesion-promoting layer of polycarbonate to a thickness of <0.1 μm (dry). The pigments cis-perinone (Novoperm Red TG 02, according to Formula 4), perylene-3,4,9,10-tetracarboxylic acid diimidebisbenzimidazole (Formula 5) and 4,10-dibromoanthanthrone (Hostaperm Scarlet GO, Formula 6) were deposited thereon, respectively, by vapor deposition in vacuo ($1.33\times10^{-7}$ to $10^{-8}$ bar) under mild conditions. The thicknesses of the homogeneous vapor-deposited pigment layers are in the region of 100 to 140 $mg/m^2$. A solution of 50 parts of To 1920, 25 parts of phenoxy resin (PKHH) and 25 parts of polyester resin (L 206) in tetrahydrofuran was coated onto the layers, resulting in a dry thickness of approximately 10 μm. Other layers were prepared with varying proportions of cellulose nitrate (standard type H 27, containing 18% dioctylphthalate) instead of binder. The improvement in photosensitivity achieved with relatively low proportions of CN on the various pigment layers is shown in Table 5;

TABLE 5

| Layer + pigment | Proportion of CN % | $-U_o$ (V) | $-U_E$ (V) after 1 sec | $E_{\frac{1}{2}}$ | $E_{\frac{1}{4}}$ | $E_{\frac{1}{8}}$ ($\mu J/cm^2$) | |
|---|---|---|---|---|---|---|---|
| Cis-perinone (Formula 4) 0-layer | — | 560 | 79 | 4.2 | 10.75 | — | |
| 1 | 1 | 540 | 23 | 1.2 | 2.3 | 4.36 | |
| 2 | 5 | 545 | 11 | 1.18 | 2.22 | 3.74 | 50 pts. To 1920<br>25 pts. PKHH<br>20 pts. L 206 |
| 3 | 10 | 520 | 7 | 1.22 | 2.26 | 3.66 | 50 pts. To 1920<br>20 pts. PKHH<br>20 pts. L 206 |
| Formula 5 0-layer | — | 500 | 51 | 2.98 | 7.64 | 16.97 | |
| 1 | 1 | 520 | 27 | 1.61 | 4.1 | 8.19 | |
| 2 | 5 | 540 | 15 | 1.15 | 2.75 | 5.16 | see above |
| 3 | 10 | 480 | 7 | 1.16 | 2.74 | 4.92 | see above |
| Formula 6 0-layer | — | 550 | 47 | 3.41 | 8.13 | 14.73 | |
| 1 | 1 | 550 | 19 | 1.58 | 3.35 | 6.33 | |
| 2 | 5 | 570 | 11 | 1.42 | 2.84 | 4.98 | see above |
| 3 | 10 | 540 | 7 | 1.34 | 2.64 | 4.3 | see above |

EXAMPLE 10

A vapor-deposited N,N'-dimethylperylimide layer according to Example 1 was homogeneously coated with a solution containing 60 parts of To 1920, 20 parts of polycarbonate (Makrolon 3200) and 20 parts of polyester resin (Dynapol L 206). Two further coating solutions which additionally contained, respectively, (a) 3% cellulose nitrate, based on the foregoing solid content, and (b) 0.5% phthalic anhydride, based on the foregoing solid content, were then coated onto the pigment layer.

These layers were studied in a copier arrangement, under identical electrophotographic and erasure conditions, for their cyclic behavior (100 cycles), especially for their residual discharge behavior:

| Layer | Layer weight per unit area ($g/m^2$) | $-U_{D1-100}$ (V) | $-U_{W1-100}$ (V) White master, middle apperture setting | $-U_{R1-100}$ (V) After erasure |
|---|---|---|---|---|
| 0-Layer | 12.0 | 450–470 | 130–150 | 40–80 |
| (a) | 12.2 | 440–450 | 120–120 | 20–40 |
| (b) | 11.9 | 450–460 | 120–130 | 10–20 |

$U_D$ - Charge acceptance in dark
$U_W$ - Charge acceptance for middle aperture setting (1-3-5)
$U_R$ - Charge acceptance after erasure

EXAMPLE 11

To a tetrahydrofuran solution containing 52 parts of To 1920, 35 parts of polycarbonate (Makrolon 2405) and 10 parts of polyester resin (Dynapol L 206), there were also added (a) 3 parts of cellulose nitrate (Standard type HP 10), or (b) 1.5 parts of cellulose nitrate (Standard type HP 10) and 1.5 parts of 9,10-dibromoanthracene (DBA) or (c) 3 parts of DBA.

These coating solutions were uniformly coated onto a vapor-deposited pigment layer according to Example 1 (Formula 1) by flow application in a coating machine, and then were dried.

The photosensitivities of the recording materials with variously activated charge-transport layers are shown in Table 6 (light intensity ~6.5 $\mu W/cm^2$).

TABLE 6

| Layer | Layer weight per unit area ($g/m^2$) | $-U_o$ (V) | $U_E$ (V) after 1 sec | $E_{\frac{1}{2}}$ | $E_{\frac{1}{4}}$ | $E_{\frac{1}{8}}$ ($\mu J/cm^2$) |
|---|---|---|---|---|---|---|
| (a) | 14.3 | 480 | 47 | 1.06 | 2.45 | 5.18 |

TABLE 6-continued

| Layer | Layer weight per unit area ($g/m^2$) | $-U_o$ (V) | $U_E$ (V) after 1 sec | $E_{\frac{1}{2}}$ | $E_{\frac{1}{4}}$ | $E_{\frac{1}{8}}$ ($\mu J/cm^2$) |
|---|---|---|---|---|---|---|
| (b) | 14.6 | 480 | 43 | 1.01 | 2.10 | 4.39 |
| (c) | 14.5 | 470 | 51 | 1.09 | 2.57 | 5.79 |

EXAMPLE 12

A polyester film coated with aluminum by vapor deposition was coated with a thin primer coating of polycarbonate (less than 100 $mg/m^2$) (dry), and then with N,N'-dimethylperylimide (approximately 130 $mg/m^2$) homogeneously deposited by vapor deposition. The layer was thereafter coated with a solution containing 98 parts of polyvinylcarbazole (Luvican® M 170) and 2 parts of polyester resin (Adhesive® 49000) to a thickness of about 6 μm after drying. The charge-transport layer, with a film thickness of about 6 μm, was activated by adding 1 part or 3 parts of 9,10-dibromoanthracene.

Photosensitivity measurements were made as in Example 1:

| Layer | $-U_o$ (V) | $U_E$ (V) after 3 sec | $E_{\frac{1}{2}}$ | $E_{\frac{1}{4}}$ | $E_{\frac{1}{8}}$ ($\mu J/cm^2$) |
|---|---|---|---|---|---|
| 0-Layer | 480 | 19 | 1.86 | 3.41 | 5.06 |
| +1 pt. DBA | 470 | 11 | 1.86 | 3.29 | 4.79 |
| +3 pts. DBA | 500 | 11 | 1.59 | 2.84 | 4.08 |

EXAMPLE 13

Charge-transport layers of the following compositions:

(a) 50 parts of 1,3,5-triphenylpyrazoline (TPP) and 50 parts of polycarbonate (Makrolon 3200), (b) 50 parts of TPP, 49 parts of polycarbonate and 1 part of 9,10-dichloroanthracene (DCA), and (c) 50 parts of TPP, 47 parts of polycarbonate and 3 parts of DCA were deposited, to a thickness of about 10 μm, on a charge carrier-generating layer, as described in Example 12.

The photosensitivity measurements at a light intensity of 3.8 $\mu W/cm^2$ yielded the following values:

| Layer | $-U_o$ (V) | $U_E$ (V) after 3 sec | $E_{\frac{1}{2}}$ | $E_{\frac{1}{4}}$ | $E_{\frac{1}{8}}$ ($\mu J/cm^2$) |
|---|---|---|---|---|---|
| (a) | 560 | 59 | 1.62 | 3.93 | 9.61 |
| (b) | 550 | 31 | 1.08 | 2.22 | 4.15 |
| (c) | 540 | 31 | 1.04 | 1.99 | 3.52 |

EXAMPLE 14

Thin coatings (less than 0.1 μm) of polycarbonate (a) or of 98 parts of polycarbonate and 2 parts of DBA (b) were deposited, respectively, onto a polyester film coated (by vapor deposition) with aluminum. Each sample was then coated with a uniform, vapor-deposited N,N'-dimethylperylimide (Formula 1) layer according to Example 1. Layer thicknesses were approximately 120 $mg/m^2$.

These charge carrier-generating systems were then uniformly coated with a tetrahydrofuran solution containing 52 parts of To 1920 and 48 parts of phenoxy resin, resulting in a layer weight per unit area of 13.5 $g/m^2$ in each case.

The photosensitivities measured as in Example 1 turned out as follows:

| Layer | $-U_o$ (V) | $U_E$ (V) after 3 sec | $E_{\frac{1}{2}}$ | $E_{\frac{1}{4}}$ ($\mu J/cm^2$) |
|---|---|---|---|---|
| (a) | 560 | 134 | 3.68 | 11.14 |
| (b) | 560 | 75 | 1.71 | 4.61 |

EXAMPLE 15

A precoated aluminum/polyester film coated with N,N'-dimethylperylimide by vapor dposition was coated with a solution comprising 50 parts of 4-chloro-2(4-diethylaminophenyl)-5-(4-methoxyphenyl)oxazole (m.p. 104° C.) and 50 parts of polycarbonate to a thickness of about 10 μm (dry). Further, variously activated charge-transport films of the same thickness were prepared in which polycarbonate (49 parts and 47 parts) was replaced by 1 and 3 parts, respectively, of 9,10-dichloroanthracene (DCA).

The following photosensitivities resulted:

| Layer | Proportion of DCA, % | $-U_o$ (V) | $U_E$ (V) after 5 sec | $E_{\frac{1}{2}}$ | $E_{\frac{1}{4}}$ | $E_{\frac{1}{8}}$ ($\mu J/cm^2$) |
|---|---|---|---|---|---|---|
| 0 | 0 | 490 | 35 | 1.33 | 3.03 | 7.76 |
| 1 | 1 | 500 | 23 | 1.14 | 2.35 | 4.58 |
| 2 | 3 | 470 | 15 | 1.09 | 2.22 | 4.03 |

EXAMPLE 16

60 g of the dyestuff N,N'-di(n-butyl)perylimide (Formula 7) were kneaded with 40 g of polyvinylbutyral (Mowital® B 20 H) in a cylinder mill to achieve homogeneous mixing. The resulting fine granulate was taken up in tetrahydrofuran and finely dispersed in a pearl mill; the dispersion was thereafter homogeneously deposited, to a thickness of about 250 $mg/m^2$, on a polyester film coated beforehand with aluminum by vapor deposition, and then was dried.

The following tetrahydrofuran solutions of charge-transport layer materials:

(a) 52 parts of To 1920, 24 parts of polyester resin and 24 parts of phenoxy resin and (b) 52 parts of To 1920, 35 parts of phenoxy resin, 8 parts of polyester resin, 3 parts of cellulose nitrate of standard type H 27 and 2 parts of 9,10-dibromoanthracene were then deposited thereon to a dry layer thickness of 13.0 $g/m^2$ and 13.4 $g/m^2$, respectively.

The following photosensitivities were measured:

| Layer | $-U_o$ (V) | $U_E$ (V) after 10 sec | $E_{\frac{1}{2}}$ | $E_{\frac{1}{4}}$ | $E_{\frac{1}{8}}$ ($\mu J/cm^2$) |
|---|---|---|---|---|---|
| a | 480 | 90 | 7 | 23 | — |
| b | 460 | 0 | 2.32 | 4.39 | 6.51 |

What is claimed is:

1. An elecrophotographic recording material comprising an electrically conducting base layer and a photoconductive system deposited thereon which comprises a layer containing a charge-carrier generating compound and a film containing a hole-transporting compound mixed with a binder, wherein said photoconductive system contains at least one monomeric acceptor additive that has electron-attracting substituents and is a compound represented by formula (I)

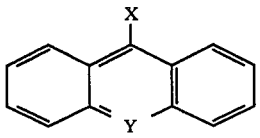

(I)

where

X is hydrogen, a halogen or a cyano group, and

Y is nitrogen or the grouping

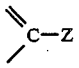

where

Z is a halogen or a cyano group, said additive being present in an amount ranging from between about 0.2 to 10% by weight, based on total coating.

2. A recording material as claimed in claim 1 wherein X and Z are each a chlorine or bromine respectively.

3. A recording material as claimed in claim 1, wherein said additive is selected from the group consisting of 9,10-dibromoanthracene, 9,10-dichloroanthracene, 9-chloroanthracene and 9-bromoanthracene.

4. A recording material as claimed in claim 1, wherein said additive is 9-chloroacridine.

5. A recording material as claimed in claim 1, wherein said additive is present in the layer containing the charge-transporting compound.

6. A recording material as claimed in claim 1, wherein said binder is selected from the group consisting of a polyester resin, a polycarbonate and a phenoxy resin.

7. A recording material as claimed in claim 1, further comprising an insulating intermediate layer that is immediately adjacent said base layer.

8. A recording material as claimed in claim 7, wherein said insulating intermediate layer comprises said additive and is in contact with the charge-carrier generating layer.

9. A recording material as claimed in claim 1, wherein said additive is only present in said film containing a charge-transporting compound mixed with a binder.

* * * * *